US009055832B2

(12) United States Patent
Regan

(10) Patent No.: US 9,055,832 B2
(45) Date of Patent: Jun. 16, 2015

(54) LIGHTED LID FOR BEVERAGE CONTAINER

(71) Applicant: Colin Regan, Wabamun (CA)

(72) Inventor: Colin Regan, Wabamun (CA)

( * ) Notice: Subject to any disclaimer, the term of this patent is extended or adjusted under 35 U.S.C. 154(b) by 0 days.

(21) Appl. No.: 14/221,625

(22) Filed: Mar. 21, 2014

(65) Prior Publication Data

US 2014/0284330 A1 Sep. 25, 2014

Related U.S. Application Data

(60) Provisional application No. 61/804,283, filed on Mar. 22, 2013.

(51) Int. Cl.
*F21V 33/00* (2006.01)
*A47G 19/22* (2006.01)

(52) U.S. Cl.
CPC .... *A47G 19/2272* (2013.01); *A47G 2019/2238* (2013.01)

(58) Field of Classification Search
CPC ..... F21V 33/0036
USPC ..... 362/101
See application file for complete search history.

(56) References Cited

U.S. PATENT DOCUMENTS

| | | | | |
|---|---|---|---|---|
| 5,749,491 | A * | 5/1998 | Wylder et al. | 220/719 |
| 6,003,711 | A | 12/1999 | Bilewitz | |
| 8,662,696 | B2 * | 3/2014 | Lederer et al. | 362/101 |
| 2003/0076673 | A1 * | 4/2003 | Diak/Ghanem | 362/101 |
| 2005/0184078 | A1 * | 8/2005 | Oas | 220/756 |
| 2006/0061985 | A1 * | 3/2006 | Elkins | 362/101 |
| 2014/0204565 | A1 * | 7/2014 | Zwierstra | 362/101 |

* cited by examiner

*Primary Examiner* — William Carter
(74) *Attorney, Agent, or Firm* — Dentons US LLP; Brian R. McGinley

(57) ABSTRACT

A lid for a beverage container or travel mug is provided that has one or more visual indicators to identify the location of the pour spout opening of the container or mug in low light conditions.

6 Claims, 4 Drawing Sheets

LIGHTED LID FOR BEVERAGE CONTAINER

CROSS-REFERENCE TO RELATED APPLICATIONS

This application claims priority of U.S. provisional patent application Ser. No. 61/804,283 filed Mar. 22, 2013, which is incorporated by reference into this application in its entirety.

TECHNICAL FIELD

The present disclosure is related to the field of beverage containers, in particular, lids for beverage container having lids with a visual indicator to indicate location of an opening of the container when used in low ambient light conditions.

BACKGROUND

Travel beverage containers and mugs are popular for use with coffee and other beverages. They are often used by people to avoid using disposable cups and generate unnecessary waste. They are also used by people while they are driving their vehicles. People often purchase such beverages at drive-through restaurants. In early morning hours, and in the late evening, the ambient light in a vehicle can be quite low and it is difficult for a person to locate the spout or opening of their beverage container, resulting in the person spilling their beverage onto themselves. If the beverage is hot coffee, it can be painful or can even cause injury to the person if they spill the coffee onto themselves.

It is, therefore, desirable, to provide a lid for a beverage container having a visual indicator to locate the opening of the container to drink from so as to prevent spilling the beverage.

SUMMARY

A lid for a beverage container is provided. In some embodiments, the lid can comprise an outer lid portion configured to removably fit into the mouth of a beverage container, such as a travel mug or the like, and an inner lid portion configured to rotatably fit within the outer lid portion. In some embodiments, the lid can be configured as a replacement lid for existing beverage containers or travel mugs. Each of the outer lid and inner lid portions can comprise an opening configured to allow fluid in the container to flow out of the container and consumed by a person when the openings of the outer and inner lid portions are aligned. Each of the outer lid and inner lid portions can also comprise vents that can align when the openings are aligned to provide venting to the container and allow fluid to pour easily out of the container. In some embodiments, the inner lid portion can comprise a visual indicator disposed near the opening to indicate its location in low ambient light conditions. In some embodiments, the visual indicator can comprise one or more light emitting diodes ("LED" or "LEDs") that can light up when the openings in the outer and inner lid portions are aligned. In other embodiments, a plurality of LEDs can be disposed on the inner lid portion and configured to form a visual pointer towards the opening to indicate its location in low ambient light conditions.

Broadly stated, in some embodiments, a lid is provided for a beverage container comprising a mouth, the lid comprising: an outer lid portion comprising a sidewall and a bottom configured to form a cup-like structure forming a first opening, the outer lid portion comprising a second opening configured to provide communication between the container and the first opening, the outer lid portion configured to be removably inserted into the mouth of beverage container; an inner lid portion disposed in the first opening, the inner lid portion configured to rotatably fit within the first opening, the inner lid portion comprising a third opening configured to align with the second opening; and a visual indicator disposed on the inner lid portion near the second opening, the visual indicator configured to provide a visual indication of the location of the third opening when the inner lid portion is rotated to align the third second opening with the second opening.

Broadly stated, in some embodiments, a beverage container is provided, comprising: a sidewall portion and a bottom portion, the combination thereof forming a mouth and further configured to hold a beverage or liquid; and a lid, comprising: an outer lid portion comprising a sidewall and a bottom configured to form a cup-like structure with a first opening, the outer lid portion comprising a second opening configured to provide communication between the container and the first opening, the outer lid portion configured to be removably inserted into the mouth of beverage container, an inner lid portion disposed in the first opening, the inner lid portion configured to rotatably fit within the first opening, the inner lid portion comprising a third opening configured to align with the second opening, and at least one visual indicator disposed on the inner lid portion near the second opening, the visual indicator to provide a visual indication of the location of the third opening when the inner lid portion is rotated to align the third second opening with the second opening.

Broadly stated, in some embodiments, the visual indicator can comprise at least one light emitting diode and a power supply configured to provide electrical power to the at least one light emitting diode when the inner lid portion is rotated to align the third opening with the second opening.

Broadly stated, in some embodiments, the power supply can comprise a battery and a wiper contact operatively connected to the at least one light emitting diode, the wiper contact configured to contact the battery and close an electrical circuit to provide the electrical power to the at least one light emitting diode when the inner lid portion is rotated to align the third opening with the second opening.

Broadly stated, in some embodiments, the outer lid portion can further comprise a first vent configured to provide communication between the container and the first opening, and the inner lid portion can further comprise a second vent configured to align with the first vent when the inner lid portion is rotated to align the third opening with the second opening.

BRIEF DESCRIPTION OF EMBODIMENTS

Figure 1:
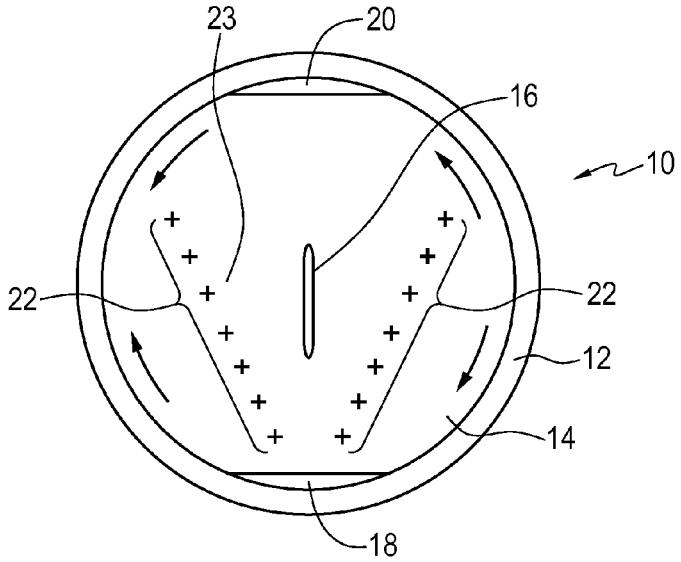
FIG. 1 is a top plan view depicting one embodiment of a lighted lid for a beverage container.
Figure 2:
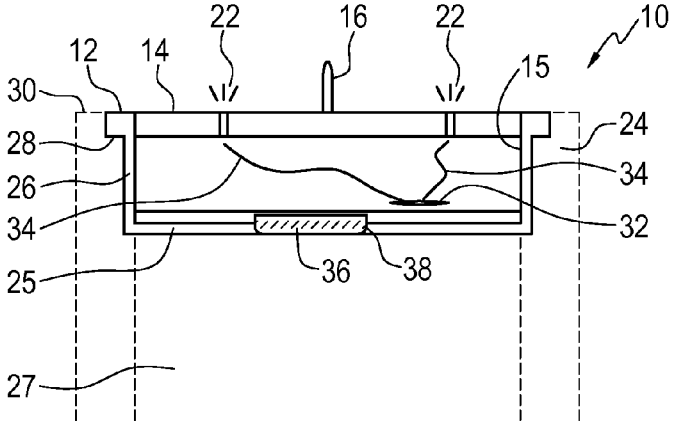
FIG. 2 is a side cross-section elevation view depicting the lighted lid of FIG. 1.

A lighted lid for a beverage container is provided. Referring to FIGS. 1 and 2, one embodiment of cup lid 10 is shown.

In some embodiments, lid 10 can comprise outer lid portion 12 and inner lid portion 14 rotatably disposed in opening 15 thereof. Outer lid portion 12 can comprise sidewall 26 and bottom 25 to form opening 15. In some embodiments, sidewall 26 can further comprise flange 28 extending perpendicularly therefrom, flange 26 configured to sit on top edge 30 of travel cup 24. Inner lid portion 14 can comprise handle 16 disposed thereon to enable a person to grasp and rotate inner lid portion 14. In FIGS. 1 and 2, handle 16 is shown as a flattened protrusion extending upwardly from inner lid portion 14, although handle 16 can comprise any configuration as well known to those skilled in the art to carry out its function. In some embodiments, inner lid portion 14 can comprise pour spout opening 18 and vent 20, wherein cup lid 10 can further comprise a corresponding pour spout opening and vent (not shown) to provide communication to interior 27 of travel cup 24 when inner lid portion 14 is rotated relative to outer lid portion 12 to align the spout openings and vents. In the illustrated embodiment, opening 18 and vent 20 are shown as openings formed by the removal of portions of inner lid portion 14 although it is obvious to those skilled in the art that opening 18 and vent 20 can comprise any suitable or equivalent configuration.

Figure 3:
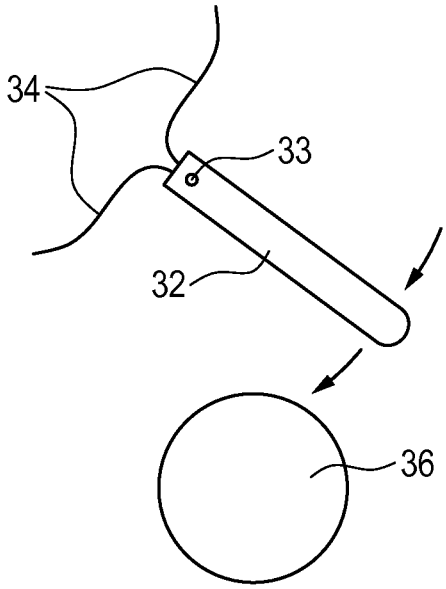
FIG. 3 is a top plan view depicting the wiper contact and battery of the lighted lid of FIG. 1.

In some embodiments, cup lid 10 can comprise battery 36, such as a watch-style battery well known to those skilled in the art, disposed in battery holder 38 disposed in bottom 25. In some embodiments, battery holder 38 can comprise a recess disposed or formed in bottom 25, which can be accessible by removing inner lid portion 14 from outer lid portion 12. In some embodiments, inner lid portion 14 can comprise one or more LEDs 22 disposed thereon and/or therethrough, operatively attached to wires 34 that can be, in turn, operatively attached to contact wiper 32 at connection 33. Contact wiper 32 can be configured to rotate as inner lid portion 14 is rotated relative to outer lid portion 12 (as shown in FIG. 3), and can be further configured to contact battery 36 when the aforementioned pour spouts and vents are aligned thus closing an electrical circuit between battery 36 and LEDs 22, thereby causing LEDs 22 to illuminate. While not shown in FIGS. 1 and 2, it should be obvious to those skilled in the art that wires 34 can be connected to the anodes or to the cathodes of LEDs 22, depending on whether wiper contact 32 contacts the positive terminal or negative terminal of battery 36, wherein the cathodes, or the anodes (as the case may be), of LEDs 22 can be operatively connected to the negative terminal, or positive terminal (as the case may be), of battery 36, either through additional wires or through a conductive circuit path formed in inner lid portion 14 and outer lid portion 12 to battery 36, as well known to those skilled in the art. In other embodiments, the aforementioned electrical circuit can further comprise one or more other electrical or electronic components (not shown), such as a resistor, a diode, a zener diode or any other suitable component well known to those skilled in the art to adjust, set or otherwise set a suitable electrical current through LEDs 22 to cause them to illuminate, the number, type and value of such other electrical or electronic component selected by those skilled in the art depending on the number of LEDs 22 used.

In some embodiments, LEDs 22 can be configured to form a visual indicator or pointer towards pour spout opening 18, thus providing a visual indication of opening 18. In FIG. 1, a plurality of LEDs 22 are shown in V-shaped configuration 23 pointing towards opening 18 although it is obvious to those skilled in the art that one or more LEDs 22 can be used in any suitable physical configuration to provide a visual indication of the location of opening 18 when inner lid portion 14 is rotated to align the pour spout openings and vents. When inner lid portion 14 is rotated back to close off opening 18 and vent 20, wiper contact 32 can disconnect from battery 36, thus turning off LEDs 22. In some embodiments, cup lid 10 can be formed to fit into any type or size of beverage container, or can be configured to replace the lid of an existing beverage container or travel mug.

Figure 4:
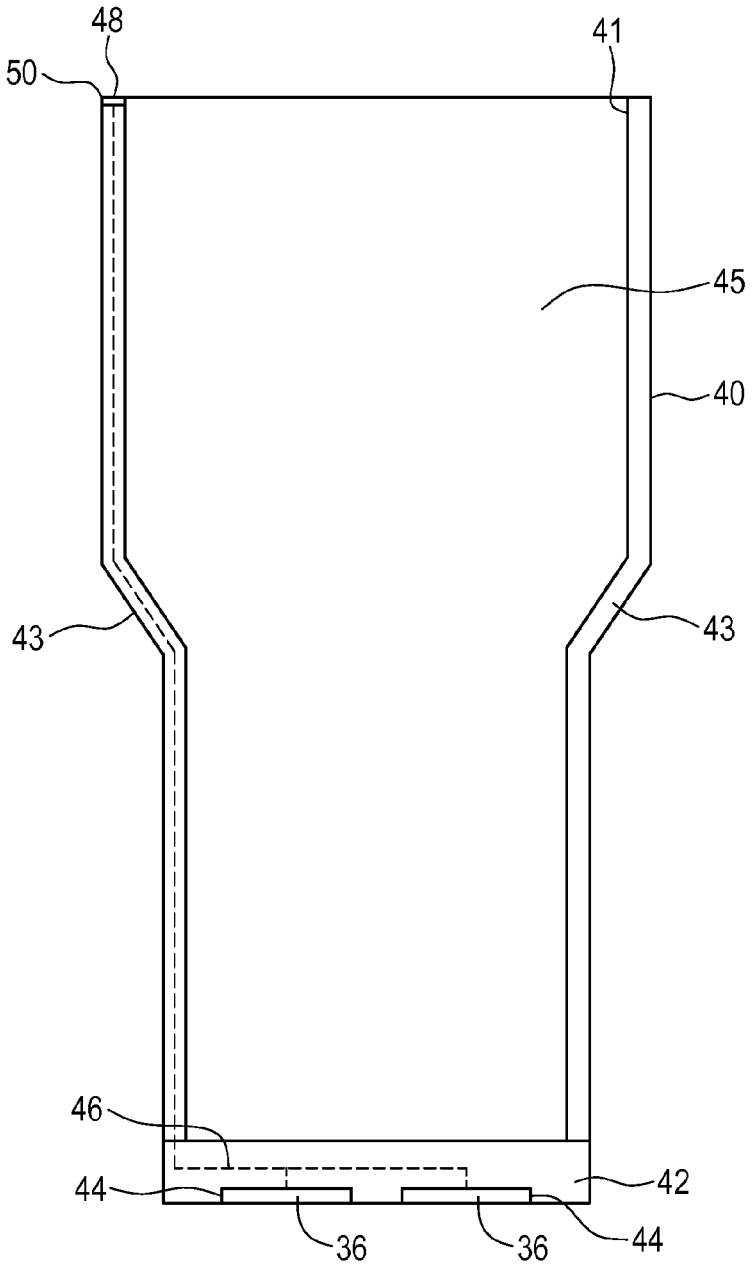
FIG. 4 is a side cross-section elevation view depicting a beverage container for use with another embodiment of a lighted lid.
Figure 5:
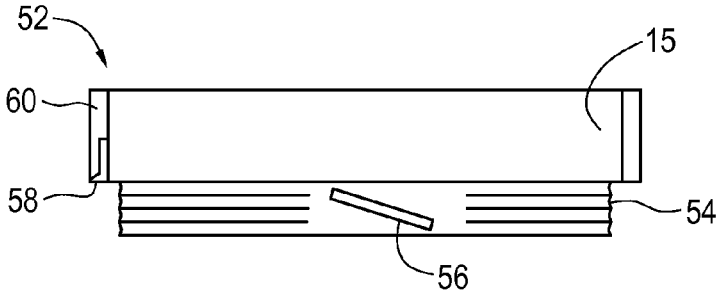
FIG. 5 is a side elevation view depicting another embodiment of a lighted lid for use with the beverage container of FIG. 4.
Figure 6:
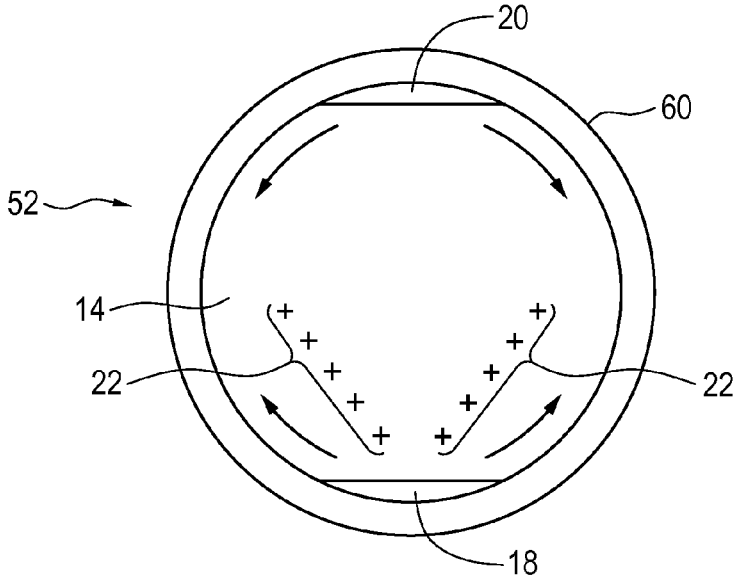
FIG. 6 is a top plan view depicting the lighted lid of FIG. 5.

Referring to FIGS. 4, 5 and 6, another embodiment of a lighted lid is shown. In this embodiment, the lighted lid can be provided with a travel mug. In some embodiments, travel mug 40 can be configured for use with cup lid 52. In this embodiment, travel mug 40 can comprise sidewall 43 and bottom 42 configured to form interior 45 and mouth 41. In some embodiments, bottom 42 can comprise one or more battery holders 44 to receive and hold one or more battery 36, which can be operatively connected to electrical contact 48 disposed on top edge 50 of travel mug 40 via wires 46 disposed in sidewall 43. In some embodiments, cup lid 52 can comprise outer lid portion 60 and inner lid portion 14 rotatably disposed in opening 15 thereof. In some embodiments, cup lid 52 can comprise contact wiper 32 operatively connected to one or more LEDs 22 disposed on inner lid portion 14 via wires 34, as similarly shown in FIGS. 1 and 2. In this embodiment, contact wiper 32 can be configured to contact electrical contact 58 disposed in outer lid portion 60 when inner lid portion 14 is rotated relative to outer lid portion 60, and wherein contact 58 can be configured to operatively couple to contact 48 when cup lid 52 is inserted into mouth 41 of travel mug 40. In some embodiments, cup lid 52 can further comprise twist lock 56 configured to engage a corresponding catch disposed in mouth 41. In some embodiments, cup lid 52 can further comprise rubber seal 54 disposed about outer lid portion 60, rubber seal 54 configured to provide a liquid seal between cup lid 52 and travel mug 40 when cup lid 52 is inserted into mouth 41.

In operation, cup lid 52 can be inserted into mouth 41 and rotated to twist lock cup lid 52 to travel mug 40, thereby sealing cup lid 52 to travel mug 40, and to enable contact 58 to connect to contact 48. When inner lid portion 14 is rotated to align pour spout opening 18 and vent 20 with a corresponding opening and vent disposed through outer lid portion 60 to provide communication to interior 45, wiper contact 32 can operatively connect to contact 58, thereby closing an electrical circuit between LEDs 22 and battery 36 thus causing LEDs 22 to illuminate to indicate the location of pour spout opening 18. When inner lid portion 14 is rotated back, pour spout opening 18 and vent 20 can close, and wiper contact 32 can disengage from contact 58 thus turning off LEDs 22.

Although a few embodiments have been shown and described, it will be appreciated by those skilled in the art that various changes and modifications can be made to these embodiments without changing or departing from their scope, intent or functionality. The terms and expressions used in the preceding specification have been used herein as terms of description and not of limitation, and there is no intention in the use of such terms and expressions of excluding equivalents of the features shown and described or portions thereof, it being recognized that the invention is defined and limited only by the claims that follow.

I claim:

1. A lid for a beverage container comprising a mouth, the lid comprising:

a) an outer lid portion comprising a sidewall and a bottom configured to form a cup-like structure forming a first opening, the outer lid portion comprising a second opening configured to provide communication between the container and the first opening, the outer lid portion configured to be removably inserted into the mouth of beverage container;

b) an inner lid portion disposed in the first opening, the inner lid portion configured to rotatably fit within the first opening, the inner lid portion comprising a third opening configured to align with the second opening;

c) a visual indicator disposed on the inner lid portion near the second opening, the visual indicator configured to provide a visual indication of the location of the third opening when the inner lid portion is rotated to align the third opening with the second opening; and wherein the visual indicator comprises at least one light emitting diode and a power supply configured to provide electrical power to the at least one light emitting diode when the inner lid portion is rotated to align the third opening with the second opening.

2. The lid as set forth in claim 1, wherein the power supply comprises a battery and a wiper contact operatively connected to the at least one light emitting diode, the wiper contact configured to contact the battery and close an electrical circuit to provide the electrical power to the at least one light emitting diode when the inner lid portion is rotated to align the third opening with the second opening.

3. The lid as set forth in claim 1, wherein the outer lid portion further comprises a first vent configured to provide communication between the container and the first opening, and the inner lid portion further comprises a second vent configured to align with the first vent when the inner lid portion is rotated to align the third opening with the second opening.

4. A beverage container, comprising:

a) a sidewall portion and a bottom portion, the combination thereof forming a mouth and further configured to hold a beverage or liquid; and b) a lid, comprising:

i) an outer lid portion comprising a sidewall and a bottom configured to form a cup-like structure with a first opening, the outer lid portion comprising a second opening configured to provide communication between the container and the first opening, the outer lid portion configured to be removably inserted into the mouth of beverage container, an inner lid portion disposed in the first opening, the inner lid portion configured to rotatably fit within the first opening, the inner lid portion comprising a third opening configured to align with the second opening, iii) at least one visual indicator disposed on the inner lid portion near the second opening, the visual indicator to provide a visual indication of the location of the third opening when the inner lid portion is rotated to align the third opening with the second opening; and wherein the visual indicator comprises at least one light emitting diode and a power supply configured to provide electrical power to the at least one light emitting diode when the inner lid portion is rotated to align the third opening with the second opening.

5. The beverage container as set forth in claim 4, wherein the power supply comprises a battery and a wiper contact operatively connected to the at least one light emitting diode, the wiper contact configured to contact the battery and close an electrical circuit to provide the electrical power to the at least one light emitting diode when the inner lid portion is rotated to align the third opening with the second opening.

6. The beverage container as set forth in claim 4, wherein the outer lid portion further comprises a first vent configured to provide communication between the container and the first opening, and the inner lid portion further comprises a second vent configured to align with the first vent when the inner lid portion is rotated to align the third opening with the second opening.

* * * * *